United States Patent [19]

Baumgartner

[11] 4,320,485

[45] Mar. 16, 1982

[54] MANUALLY-ACTUATED CONTACT SWITCH ARRANGEMENT FOR ELECTRONIC WATCH

[76] Inventor: Werner R. Baumgartner, Finkenweg 12, 2552 Orpund, Switzerland

[21] Appl. No.: 113,291

[22] Filed: Jan. 18, 1980

[30] Foreign Application Priority Data

Feb. 2, 1979 [CH] Switzerland ..... 966/79

[51] Int. Cl.[3] ..... G04B 29/00; H01H 3/12

[52] U.S. Cl. ..... 368/308; 200/159 R; 368/321

[58] Field of Search ..... 368/69–70, 368/88, 184–190, 276, 306, 308, 319–321; 200/159 R, 159 A

[56] References Cited

U.S. PATENT DOCUMENTS

| | | | |
|---|---|---|---|
| 3,974,351 | 8/1976 | Solou et al. | 368/187 X |
| 3,975,897 | 8/1976 | Naito | 368/188 X |
| 4,031,341 | 6/1977 | Wuthrich et al. | 200/159 R |
| 4,241,441 | 12/1980 | Murata | 368/252 |

FOREIGN PATENT DOCUMENTS

| | | | |
|---|---|---|---|
| 2633206 | 2/1977 | Fed. Rep. of Germany | 368/321 |

*Primary Examiner*—Vit W. Miska
*Attorney, Agent, or Firm*—Michael Ebert

[57] ABSTRACT

A manually-actuated contact switch arrangement for an electronic watch in which an electronic circuit board is mounted on a base plate fitted within a case, the board having a contact extending therefrom which when electrically connected to the case completes a circuit effecting a command or setting function. The arrangement includes a return spring anchored on the base plate. A section of the free end portion of this spring is received in a transverse groove in a push member displaceably seated within a bore in the case whereby the spring imposes an initial tension on the member to maintain it at a predetermined rest position. By depressing the spring-biased push member, the free end of the spring is caused to engage the contact to close the circuit.

10 Claims, 3 Drawing Figures

MANUALLY-ACTUATED CONTACT SWITCH ARRANGEMENT FOR ELECTRONIC WATCH

BACKGROUND OF INVENTION

This invention relates generally to a manually-actuated contact switch arrangement for electronic watches, and more particularly to an arrangement in which a push member received within a bore in the watch case and accessible to the user of the watch is axially displaceable against the force of a return spring to effect a contact connection producing a command or setting signal.

In one known manually-actuated contact switch arrangement for producing a command or setting signal in an electronic watch, use is made of an open metal ring, the free ends of the ring bearing contact pieces which can be swung by push members toward a mating contact. This prior construction entails a relatively large amount of space and fails to provide a precisely-defined rest position for the push members.

Other known prior art manually-actuated contact switch arrangements for electronic watches are disclosed in U.S. Pat. Nos. 3,691,753 and 4,029,821. In these known arrangements, the assembly and disassembly procedures thereof are relatively complicated and time-consuming.

SUMMARY OF THE INVENTION

In view of the foregoing, the main object of this invention is to provide a manually-actuated contact switch arrangement for electronic watches which obviates the disadvantages of prior art arrangements.

More particularly, an object of this invention is to provide a contact switch arrangement which, except for the push member, is integrated into the watch movement, thereby facilitating the assembly of the watch or its disassembly should repairs be necessary.

A significant advantage of the invention is that the rest position of the spring-biased push member is precisely determined.

Briefly stated, these objects are accomplished in an electronic watch provided with a case within which is fitted a base plate carrying an electronic circuit board and a contact extending therefrom, there being provided a manually-operated switch arrangement which when actuated connects the contact to the case to complete a circuit effecting a command or setting function.

The arrangement is composed of a push member received within a bore in the case and having its outer end accessible to the user of the watch whereby the member may be pushed inwardly. The push member or button has a lateral slot formed therein adjacent its inner end which lies within the case. Also included is a return spring so anchored on the base plate that its free end portion is selectively movable in the direction of the principal plane of the base plate and in a direction normal thereto, the free end portion having a section thereof seated in the slot of the push member to exert an initial tension thereon in the axial direction to hold the push member in a pre-determined rest position.

Thus when the push member is manually depressed by the user against the return spring tension, the free end portion of the return spring is caused to engage the contact to complete a circuit to said case to effect the command or setting function. The return spring is disengageable from the push member by moving the free end portions in a direction normal to the principal plane of the base plate.

OUTLINE OF THE DRAWINGS

For a better understanding of the invention as well as other objects and further features thereof, reference is made to the following detailed description to be read in conjunction with the accompanying drawings, wherein.

DESCRIPTION OF INVENTION

Figure 1:
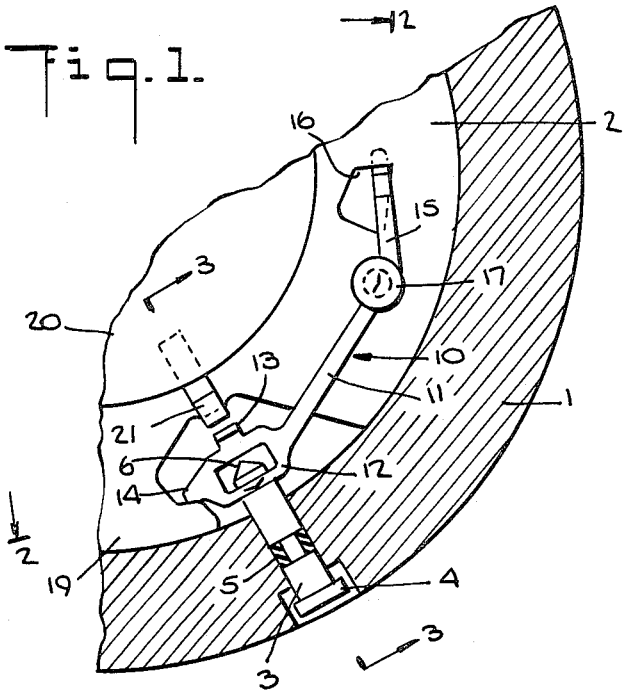
FIG. 1 illustrates a portion of an electronic watch which incorporates a manually-actuated contact switch arrangement in accordance with the invention, the watch being sectioned in a plane parallel to the principal plane of the watch.

The embodiment of the invention shown by way of example is an analog display electronic watch, as illustrated in the figures, the watch including a case 1 and a metal base plate 2. In principle, the invention is also applicable to electronic watches of other types such as a digital display watch where in lieu of an actual plate, there exists a module in the form of a plastic support. The term base plate as used herein encompasses a module which fits into the case.

It is essential in an electronic watch of the abovementioned types that the watch include at least one manually-operated push member or push button for actuating a contact means. For this purpose, the longitudinal axis of the push member may, as shown in the drawing, extend in a direction parallel to the main dimension of the base plate or module. Also, conceivable are push members or buttons whose direction of displacement is perpendicular to the principal plane of the base plate or module.

Figure 3:
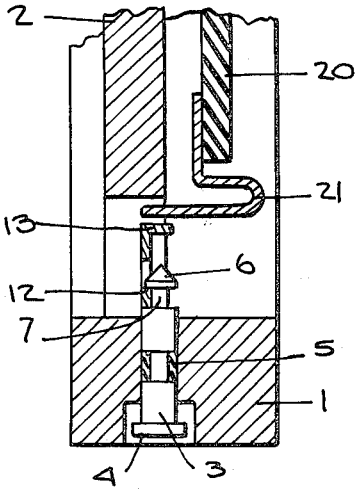
FIG. 3 is a section taken in the plane indicated by line 3—3 in FIG. 1.

It will be seen in FIGS. 1 and 3 that push member 3 is displaceably received within a borehole formed in metal case 1 and is provided with a head 4 accessible to the user of the watch so that the member may be manually depressed. A packing 5 is received within an annular groove formed in push member 3 to provide a seal against moisture and dust.

The inner end 6 of push member 3 which is directed toward the center of the watch has a conically tapered and pointed formation. Directly behind the conical end 6 of the push member is a circumferential groove 7 that is engaged on one side thereof by a section 12 of the free end portion of a return spring, the spring being generally designated by numeral 10. This free end portion forms an extension of a bent spring arm 11 and bears a bent tab 13. The free end portion of the spring is furthermore provided with a nose 14. In its rest position, nose 14 abuts a limiting stop 19 profiled on the base plate.

Figure 2:
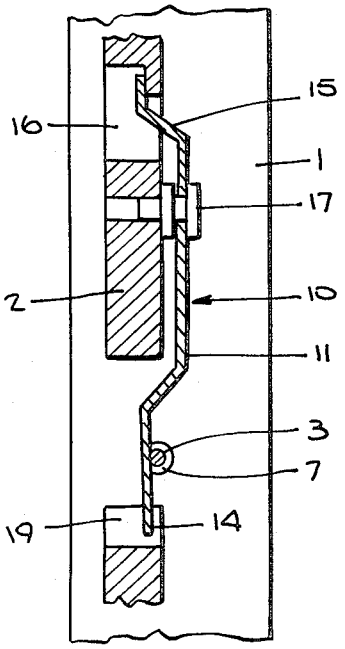
FIG. 2 is a section taken in the plane indicated by line 2—2 in FIG. 1.

Return spring 10, which has two arms, is supported at an intermediate position on a small post 17. The other arm 15 which is also bent, extends through an opening 16 in base plate 2, the free end of arm 15 engaging the underside of the base plate, thereby anchoring the spring. It will be evident from FIG. 2, that the somewhat flat resilient spring arm 11 of the return spring is swingable not only in a direction parallel to base plate 2 but also towards the surface of this plate.

The normal tension of spring arm 11 and the limit imposed thereon by stop 19 are such as to maintain push member 3 in a precisely-defined initial or rest position. Furthermore, section 12 on the free end portion of spring arm 11 which is seated within annular groove 7 of the push member exerts a radial pressure thereon. In other words, spring arm 11 imposes an initial axial and radial tension on the push member. In practice, spring section 12, instead of being seated in an annular groove 12 in the push member, may be seated in a transverse slot therein.

The contact means to be actuated by push member 3 is constituted in the example illustrated, by a contact spring 21 which is anchored on an insulating plate 20 where it is connected to the electronic circuit of the watch. When push member 3 is manually depressed, the bent tab 13 on the return spring is caused to engage the free end of contact spring 21, thereby connecting the contact spring to metal case 1 and grounding the circuit. Thus manual depression of the push member results in the completion of a circuit from spring contact 21 to ground to produce a signal to carry out a command or setting function.

When contact spring 13 is deflected, it comes against base plate 2 (see FIG. 3) thereby limiting the operating path of push member 3. Insulation plate 20 is mechanically attached to base plate 2, the means for this purpose not being visible in the figures.

The arrangement illustrated makes possible a simple assembly and disassembly procedure. Insulating plate 20 which in practice is the circuit board of the watch, is mounted on base plate 2. After base plate 2 is fitted into case 1, one has only to manually depress push member 3 until section 12 of the return spring snaps into annular groove 7, at which point the push member 3 is coupled to the return spring. To disassemble the watch, it is only necessary to lift spring arm 11, making it possible to slide out push member 3. Thus despite the low cost of this construction, return spring 10 is capable of carrying out several functions.

While there have been shown and described preferred embodiments of a manually-actuated contact switch arrangement for electronic watch, in accordance with the invention, it will be appreciated that many changes and modifications may be made therein without, however, departing from the essential spirit thereof.

I claim:

1. In an electronic watch provided with a case within which is fitted a base plate carrying an electronic circuit board and a contact extending therefrom, a manually-operated switch arrangement which when actuated, connects said contact to said case to complete a circuit effecting a command or setting function, said arrangement comprising:

A. a push member received within a bore in said case and having an outer end accessible to the user of the watch whereby the member may be pushed inwardly, said member having a lateral slot adjacent its inner end; and B. a return spring so anchored on the base plate that its free end portion is selectively movable in the direction of the principal plane of the base plate and in a direction normal thereto, the free end portion having a section thereof seated in the slot of said member to exert an initial tension thereon in the axial direction to hold the push member in a predetermined rest position whereby when the push member is manually depressed by the user against this tension, the free end portion of the return spring is caused to engage said contact to complete a circuit to said case to effect said command or setting function, said return spring being disengageable from said push member by moving said free end portion in a direction normal to the principal plane of the base plate.

2. An arrangement as set forth in claim 1, further including stop means to establish said rest position.

3. An arrangement as set forth in claim 2 wherein said base plate has a formation which defines said stop means.

4. An arrangement as set forth in claim 1, in which the return spring is positioned on the base plate adjacent the periphery thereof and upon actuation of the push member, is caused to swing in a plane parallel to the plane of the plate.

5. An arrangement as set forth in claim 1, wherein said slot is defined by an annular groove in said push member.

6. An arrangement as set forth in claim 1, wherein said return spring is supported at an intermediate point thereon by a post secured to the base plate to define two arms one of which includes said free end portion, the other arm being anchored in the base plate.

7. An arrangement as set forth in claim 1, wherein said return spring exerts on the push member through the section seated in the groove an initial tension which is directed radially with respect to the geometrical axis of the push member.

8. An arrangement as set forth in claim 1, wherein the inner end of the push member has a conically tapered formation.

9. An arrangement as set forth in claim 1, wherein the free end portion of the return spring includes a bent tab which engages said contact.

10. An arrangement as set forth in claim 1 wherein said contact is formed on the free end of a spring anchored on said board and connected to the circuit therein.

* * * * *